US007372219B2

(12) United States Patent
Fujimaki et al.

(10) Patent No.: US 7,372,219 B2
(45) Date of Patent: May 13, 2008

(54) BELT DRIVEN CENTRIFUGAL SEPARATOR WITH MULTI-STAGE, BELT DETERIORATION ALERTING DISPLAY

(75) Inventors: Takahiro Fujimaki, Hitachinaka (JP); Hiroyuki Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 31 days.

(21) Appl. No.: 11/542,143

(22) Filed: Oct. 4, 2006

(65) Prior Publication Data

US 2007/0075667 A1 Apr. 5, 2007

(30) Foreign Application Priority Data

Oct. 4, 2005 (JP) ..... P2005-290890

(51) Int. Cl.
*B04B 9/10* (2006.01)

(52) U.S. Cl. ..... 318/14; 318/565; 388/924; 210/85; 494/10; 494/84

(58) Field of Classification Search ..... 318/6, 318/9, 14, 432, 434, 563, 565; 388/903, 388/909, 924; 210/85; 494/7, 9, 10, 12, 494/84

See application file for complete search history.

(56) References Cited

U.S. PATENT DOCUMENTS 3,661,266 A * 5/1972 Von Rotel ..... 210/370
4,822,331 A * 4/1989 Taylor ..... 494/16
4,827,197 A * 5/1989 Giebeler ..... 318/3
5,917,688 A * 6/1999 Kido et al. ..... 361/51
6,589,155 B2 * 7/2003 Dolecek ..... 494/84

FOREIGN PATENT DOCUMENTS

JP 10-118529 5/1998
JP 2003-010734 1/2003

* cited by examiner

*Primary Examiner*—Bentsu Ro
(74) *Attorney, Agent, or Firm*—Antonelli, Terry, Stout & Kraus, LLP.

(57) ABSTRACT

In a centrifugal separator of the type in which driving power of a motor is transmitted to a rotor via a power transmission mechanism, such as a belt, a motor-rotation signal frequency fm and a rotor-rotation signal frequency fr are computed, on the basis of which a frequency ratio A (fr/fm) is computed. When the frequency ratio A exceeds the upper limit of a first predetermined range, a warning message is displayed to prompt the user to perform maintenance. When the frequency ratio A exceeds the upper limit of a second predetermined range, an alarm message is displayed and the motor is stopped.

14 Claims, 9 Drawing Sheets

BELT DRIVEN CENTRIFUGAL SEPARATOR WITH MULTI-STAGE, BELT DETERIORATION ALERTING DISPLAY

BACKGROUND OF THE INVENTION

1. Field of the Invention

The present invention relates to a centrifugal separator, and more particularly to a belt driven centrifugal separator in which driving power of a motor is transmitted to a rotor via a driving power transmission mechanism, such as belt.

2. Description of the Related Art

Rotor driving systems of a centrifugal separator can be classified into a direct driving type in which a rotor is directly coupled to the rotational shaft of the motor, and an indirect driving type in which the rotor and the motor are coupled via a driving power transmitting mechanism including, for example, a belt. The centrifugal separator of the direct driving type is more frequently used in the art than that of the indirect driving type due to simplicity in structure and high driving power transmission efficiency. However, the direct driving type centrifugal separator requires a motor to be disposed in alignment with the rotational shaft of the rotor, so that the position in which the motor is disposed is restricted and the vertical dimension of the centrifugal separator increases.

When a user desires a low height centrifugal separator, such as a tabletop centrifugal separator, for the reasons of easy-to-access to a rotation chamber, the direct driving type centrifugal separator is more suitable than the indirect driving type. The indirect driving type can provide a low height centrifugal separator because a motor can be disposed aside the rotation chamber with the use of a driving power transmission mechanism including a belt or the like to transmit the driving power of the motor to the rotor. The indirect driving type is adopted when a motor designed to use for another purpose is used for the centrifugal separator or when the direct driving type is not available for the reasons of internal arrangement of the components.

For the indirect driving type centrifugal separator, the rotational speed of the motor is controlled so that the rotational speed of the rotor is set to a target value. Typically, the rotational speed of the rotor is detected magnetically or optically. With the magnetic detection, magnets are secured to the rotor or the rotor shaft and a Hall element is disposed to confront the rotating magnets and generate pulses with a frequency proportional to the rotational speed of the rotor. With the optical detection, a photo-interrupter is used in which light emitting and light detecting elements are disposed in opposition with a disk interposed therebetween. The disk is formed with slits and coaxially attached to the rotor shaft. The light detecting element generates pulses with a frequency proportional to the rotational speed of the rotor. The pulses generated from the Hall element or the light detecting elements are applied to a microprocessor for computation of the rotational speed of the rotor. The rotational speed of the motor is controlled to be a desired value based on the rotational speed of the rotor computed by the microcomputer.

Even if the above-described control is carried out, the belt or other components of the driving power transmission mechanism would suffer from damages when slippage of the belt occurs. If the centrifugal separator is used while leaving the damaged belt as it stands, the motor might be damaged due to overload imposed thereupon or the belt might be fatally damaged. As a result, the rotor may not be able to rotate or to reach to a predetermined rotational speed even if the rotational speed of the motor is increased.

In order to prevent the damage of the motor, Japanese Patent Application Publication No. Hei-10-118529 proposes an abnormality detection system in which abnormality of the driving power transmission mechanism is detected by comparing the rotation signals of the motor and the rotor. However, the proposed abnormality detection system produces abnormal signals whenever the comparison results indicate that the rotational relation of the motor and the rotor is offset from the exactly normal status. Normally, a small amount of slippage does not cause any problem, thus can be neglected. The abnormality signals produced from the abnormality detecting system includes not only real abnormality signals but also redundant and unneeded abnormality signals.

Japanese Patent Application Publication No. 2003-10734 proposes a centrifugal separator with an abnormality detecting device in which redundant and unneeded abnormality signals are not generated.

SUMMARY OF THE INVENTION

In view of the foregoing, it is an object of the invention to provide a centrifugal separator that can accurately detect a broad range of malfunction and alert the user of the present malfunction status.

Another object of the invention is to provide a centrifugal separator that can prevent the mechanical wear of driving power transmission components, such as belt, from increasing.

Still another object of the invention is to provide a centrifugal separator that can prevent the motor from being damaged caused by the mechanical wear of the driving power transmission components.

In order to achieve the above and other objects, there is provided a centrifugal separator that includes a motor that has a driving shaft and generates driving power; a rotor that is configured to accommodate a sample subject to centrifuge; a rotational shaft that supports the rotor to be rotatable therewith; a driving power transmission mechanism that is coupled between the driving shaft and the rotational shaft and transmits the driving power of the motor to the rotational shaft on which the rotor is supported; a monitoring unit that monitors an operating status of the driving power transmission mechanism and outputs a status signal indicative of the operating status of the driving power transmission mechanism; a motor control unit that controls the motor; and a multi-stage alerting unit that alerts a user that the driving power transmission mechanism is one of a predetermined number of different stage malfunction statuses based on the status signal output from the monitoring unit.

When the predetermined number of different stage malfunction statuses includes a first stage malfunction status and a second stage malfunction status, the first stage malfunction status is set less serious in degree of malfunction than the second stage malfunction status. In this case, the motor control unit may forcibly stop rotations of the motor when the multi-stage alerting unit alerts the user that the driving power transmission mechanism is in the second stage malfunction status. Further, the motor control unit may control the motor to decrease torque of the motor when the multi-stage alerting unit alerts the user that the driving power transmission mechanism is in the first stage malfunction status.

Alternatively, the motor control unit may control the motor to decrease the torque of the motor on a step-by-step basis when the multi-stage alerting unit alerts the user that the driving power transmission mechanism is in the first stage malfunction status. In this case, the multi-stage alerting unit may alert the user that the driving power transmission mechanism is in the second stage malfunction status when the torque of the motor has decreased to a predetermined level.

The multi-stage alerting unit may be a display device. The display device may selectively display one of a first indication corresponding to the first stage malfunction status, and a second indication corresponding to the second stage malfunction status. The first indication may be a warning message and the second indication may be an alarm message.

The monitoring unit may include a first pulse generator that generates a first pulse signal having a first frequency determined depending upon a rotational frequency of the motor; a second pulse generator that generates a second pulse signal having a second frequency determined depending upon a rotational frequency of the rotor; and a computing unit that computes a frequency ratio of the first frequency to the second frequency. A display device may further be provided for displaying a warning message when the frequency ratio computed by the control unit is out of a first predetermined range. In this case, the motor control unit may control the motor to stop rotations when the frequency ratio computed by the control unit exceeds upper limit of a second predetermined range. It should be noted that the second predetermined range includes the first predetermined range and covers a broader range than the first predetermined range. It is preferable that the motor control unit control torque of the motor so that the frequency ratio falls within the first predetermined range.

The driving power transmission mechanism includes a first pulley provided to the driving shaft of the motor, a second pulley provided to the rotational shaft, and a belt that is supported between the first pulley and the second pulley and transmits the driving power generated by the motor to the rotational shaft.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

A centrifugal separator in accordance with a first embodiment of the invention will be described with reference to FIGS. 1 through 12B.

Figure 1:
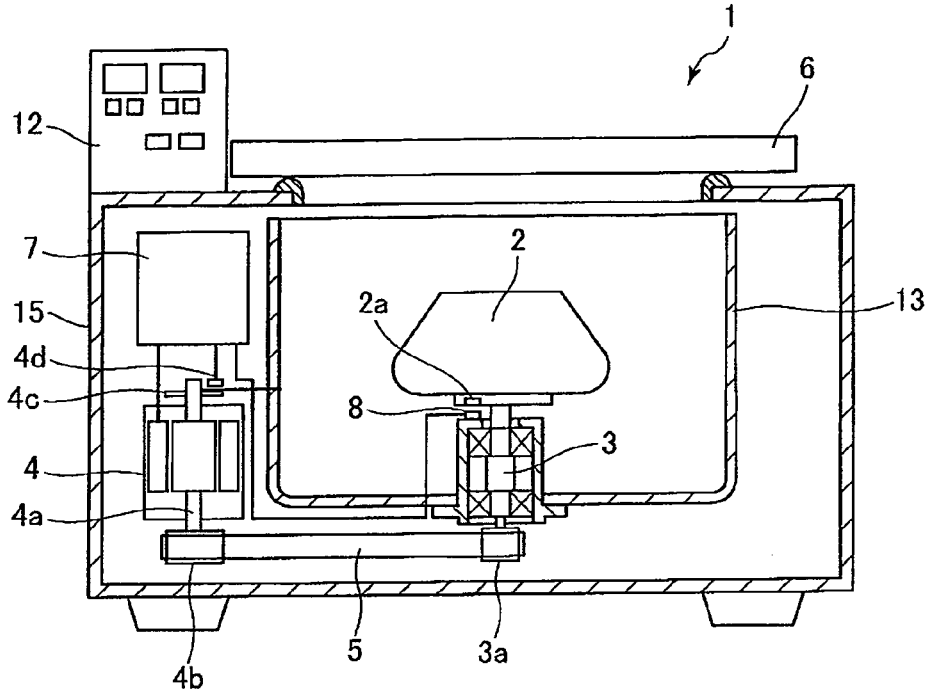
FIG. 1 is a cross-sectional view showing a centrifugal separator in accordance with a first embodiment of the invention.

FIG. 1 is a cross-sectional view showing a centrifugal separator 1 in accordance with the first embodiment. The centrifugal separator 1 has a housing 15 in which an operation chamber 13 is housed. A rotor 2 and its rotational shaft 3 are disposed inside the operation chamber 13. The rotational shaft 3 is vertically oriented and rotatably supported on the bottom wall of the operation chamber 13. The lower end portion of the rotational shaft 3 penetrates into and extends outwardly of the bottom wall of the operation chamber 13. A pulley 3*a* is fixedly attached to the lower end of the rotational shaft 3. The rotor 2 is detachably mounted on the top end portion of the rotational shaft 3 to be rotatable therewith.

A motor 4, a belt 5, and a control unit 7 are disposed outside the operation chamber 13 but inside the housing 15. The motor 4 has a driving shaft 4*a* to which a pulley 4*b* is fixedly attached. The belt 5 is supported with tension between the pulleys 4*b* and 3*a*. In accordance with the first embodiment, the pulleys 4*a*, 3*a*, and the belt 5*a* make up a driving power transmission mechanism for transmitting driving power generated by the motor 4 to the rotor 2. As the rotor 2 rotates, a sample held in the rotor 2 is subject to centrifugal separation.

A door 6 and a display panel 12 are provided above the housing 15. The door 6 covers the upper open portions of the operation chamber 13 and housing 15. The display panel 12 is used to display a set or actual rotational number of the rotor 2, time set to execute centrifugal process or expiration time from the start of centrifugal process, warning or alarm message when a malfunction occurs, as will be described later.

The rotor 2 is replaceable with another one that can be selected from a plurality of different types of rotors. The rotor 2 has a bottom plate to which two or more magnets 2*a* are secured. The magnets 2*a* serve as a discriminator for discriminating the type of the rotor 2. The magnets 2*a* are arranged on the bottom plate of the rotor 2 along a circle coaxial with the rotational shaft 3. The positional relation between the magnets 2*a* and the number of magnets 2*a* secured to the rotor 2*a* are determined in advance depending upon the type of the rotor, and are thus unique information of the rotor. Stated differently, detection of the positional relation between the magnets 2*a* and the number of magnets 2*a* secured to the rotor enables identification of the type of the rotor. Such information is stored in a memory (not shown) of the control unit 7 in relation with the type of the rotor. When it is necessary to identify the type of rotor 2, the information stored in the memory is retrieved.

Figure 3:
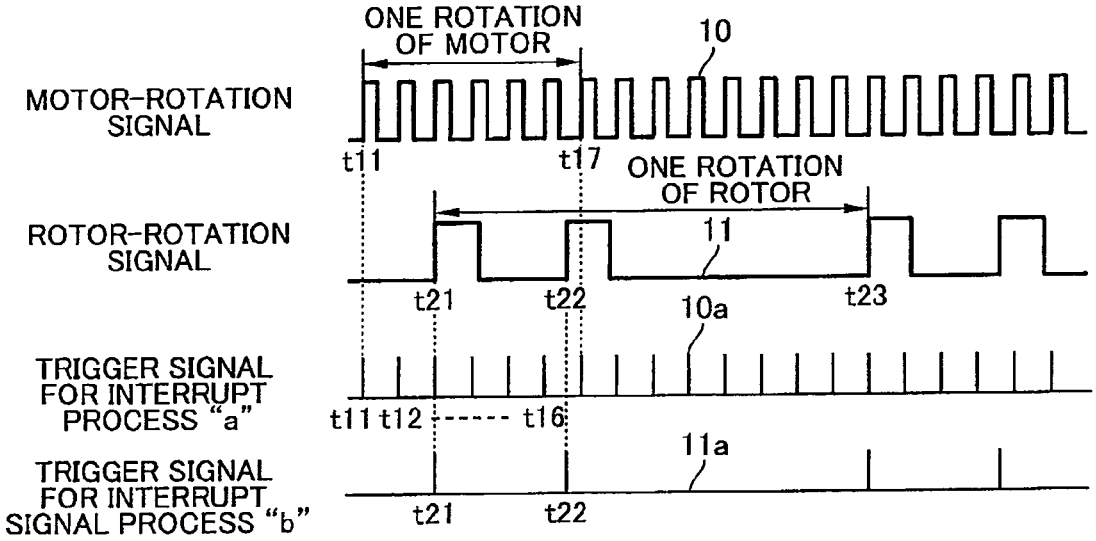
FIG. 3 is a timing chart illustrating examples of a motor-rotation signal, a rotor-rotation signal, and a timer interrupt signal.

A rotor-rotation signal generator 8 is provided beneath the rotor 2. A Hall element is used as the rotor-rotation signal generator 8 and disposed in a position where the magnets 2*a* can confront when moving with the rotor 2. The rotor-rotation signal generator 8 generates rotor-rotation signals 11 that differ in waveform depending upon the arrangement positions of the magnets 2*a* and the number of the magnets 2*a*. The rotor-rotation signal 11 is in the form of a pulse train as shown in FIG. 3. The term "rotor-rotation signal frequency" will be used hereinafter to define a number of pulses occurring per unit time. The rotor-rotation signals 11 axe transmitted to the control unit 7.

A motor-rotation signal generator 4*d* is disposed above the motor 4 for generating motor-rotation signals 10 indicative of the rotational speed of the motor 4. As shown in FIG. 3, the motor-rotation signal 10 is in the form of a pulse train. The term "motor-rotation signal frequency" will be used hereinafter to define a number of pulses occurring per unit time. The motor-rotation signal frequency is in proportion to the rotational speed of the motor 4. The motor-rotation signals 10 are transmitted to the control unit 7.

Figure 2:
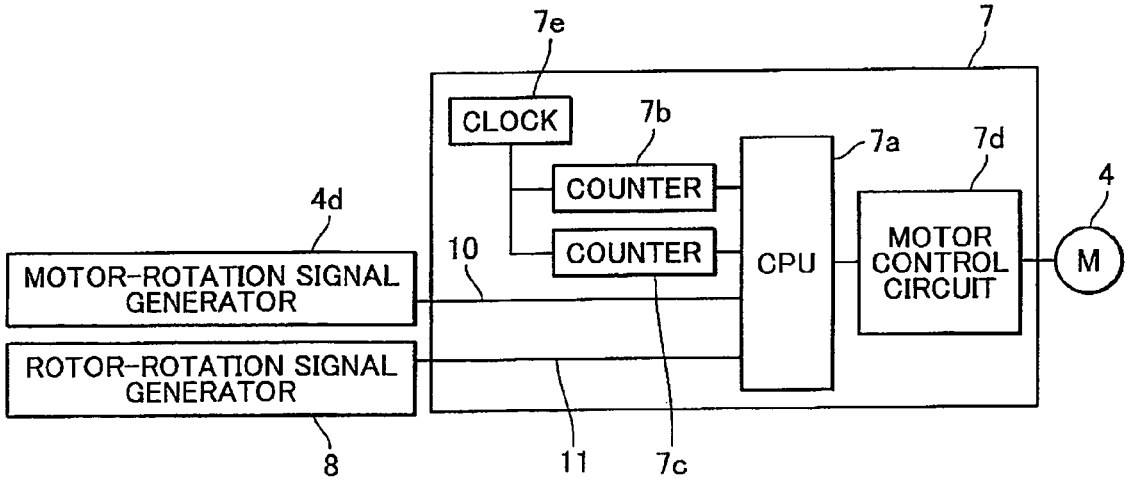
FIG. 2 is a block diagram showing an arrangement of a control unit accommodated in the centrifugal separator shown in FIG. 1.

FIG. 2 is a block diagram showing the arrangement of the control unit 7. The control unit 7 includes a central processing unit (CPU) 7*a*. Various signals are input to the CPU 7*a*. Based on the input signals, the CPU 7*a* implements various processes including a centrifugal control process, a rotor discriminating process, and a motor control process. The CPU 7*a* has a built-in memory (not shown). As will be described later, the memory of the control unit 7 has storage regions called memories TM1 through TM6 and TR1 and TR2. Counters 7*b*, 7*c* and a motor control circuit 7*d* are connected to the CPU 7*a*, and a clock 7*e* is connected to both the counters 7*c*, 7*d*. The motor-rotation and rotor-rotation signals 10, 11 are respectively applied from the motor-rotation and rotor-rotation signal generator 4*d*, 8 to the control unit 7. The control unit 7 computes actual rotational speeds of the motor 4 and rotor 2 based on the motor-rotation signal and the rotor-rotation signal, respectively. Based on the actual rotational speeds of the motor 4 and rotor 2 thus computed, the control unit 7 controls the motor 4 so that the rotor 2 stably rotate at a target rotational speed. To this end, the CPU 7*a* outputs a speed instruction signal to the motor control circuit 7*d* to control the rotational speed of the motor 4. The rotational speed of the motor 4 is controlled so that the rotational speed of the rotor 2 is brought into coincidence with the target rotational speed.

Under the aegis of the CPU 7*a*, the counter 7*b* counts up in timed relation with the clocks input from the clock 7*e* to measure a pulse-to-pulse time duration of the motor-rotation signal 10, i.e., a time duration from one rising (or falling) edge of the pulse to the succeedingly occurring rising (or falling) edge. Similarly, under the aegis of the CPU 7*a*, the counter 7*c* counts up in timed relation with the clocks input from the clock 7*e* to measure a pulse-to-pulse time duration of the rotor-rotation signal 11, i.e., a time duration from one rising (or falling) edge of the pulse to the succeedingly occurring rising (or falling) edge.

FIG. 3 is a timing chart illustrating examples of the motor-rotation signal 10, rotor-rotation signal 11, and timer interrupt signal. In accordance with the first embodiment, the motor-rotation signal 10 is given in the form of a pulse signal in which six pulses correspond to one rotation of the motor 4. The rotor-ration signal 11 is also given in the form of a pulse signal in which two pulses correspond to one rotation of the rotor 2. The number of pulses generated per one rotation of the rotor 2 from the rotor-rotation signal generator 8 is equal to the number of magnets 2*a* provided to the rotor 2.

The CPU 7*a* executes an interrupt process "a" in response to a trigger signal 10*a* produced whenever the rising edge of the motor-rotation signal 10 is detected. In the interrupt process "a", the CPU 7*a* reads the count value of counter 7*b* that indicates the pulse-to-pulse time duration of the motor-rotation signal 10. Similarly, the CPU 7*a* executes the interrupt process "b" in response to a trigger signal 11*a* produced whenever the rising edge of the rotor-rotation signal 11 is detected. In the interrupt process "b", the CPU 7*a* reads the count value of counter 7*c* that indicates the pulse-to-pulse time duration of the rotor-rotation signal 11.

Figure 4:
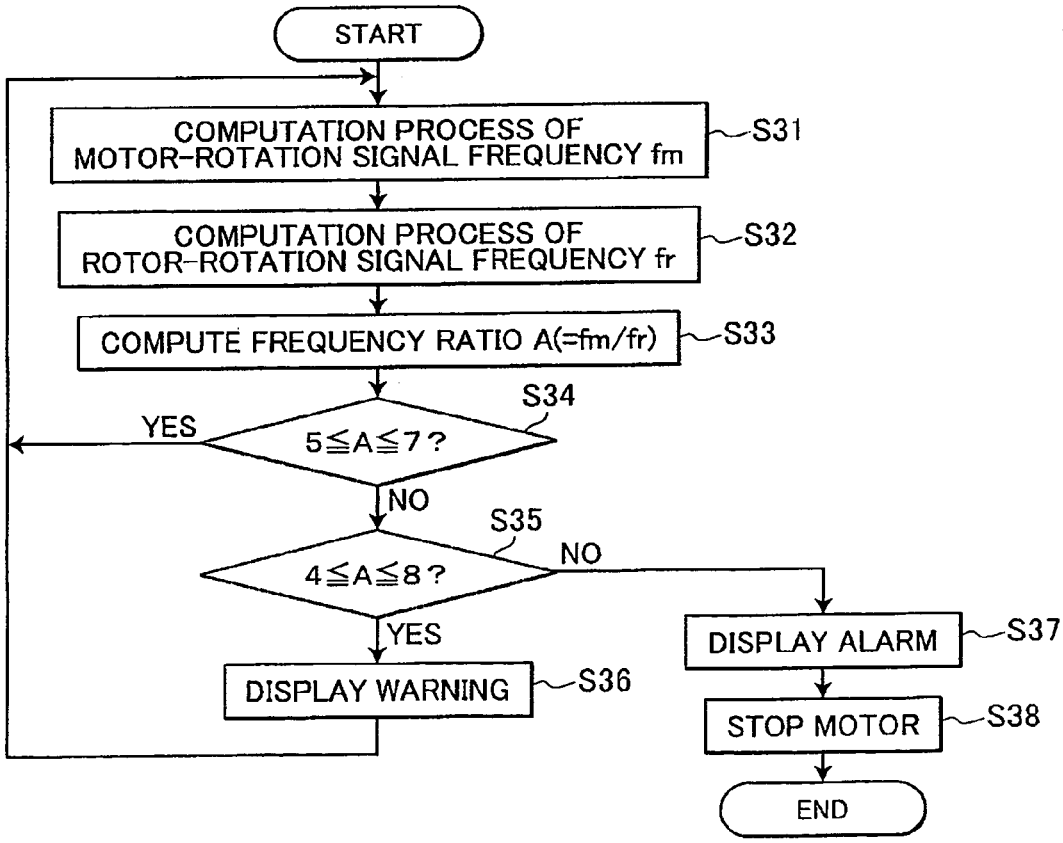
FIG. 4 is a main flowchart illustrating a motor rotational speed controlling method applied to the centrifugal separator in accordance with the first embodiment of the invention.

A method of controlling the rotational speed of the motor to attain the target rotational speed of the rotor 2 will be described with reference to FIGS. 4 through 12B. FIG. 4 is a main flowchart illustrating the motor rotational speed controlling method applied to the centrifugal separator in accordance with the first embodiment.

Figure 5:
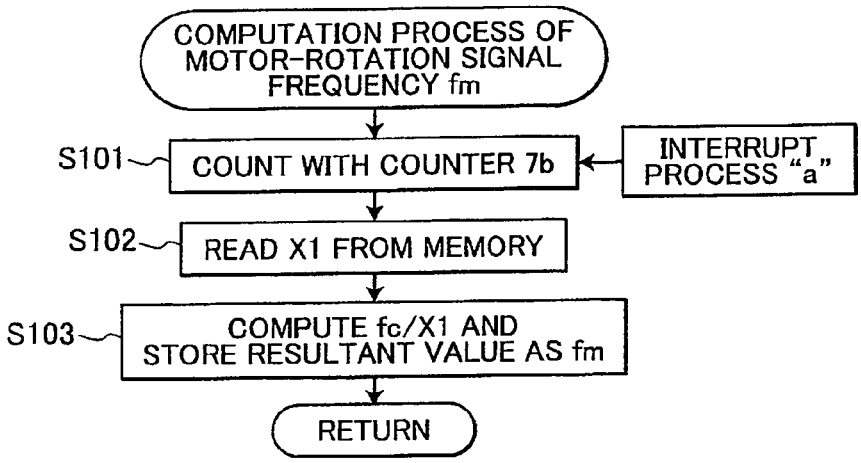
FIG. 5 is a flowchart illustrating a computation process of a motor-rotation signal frequency.
Figure 6:
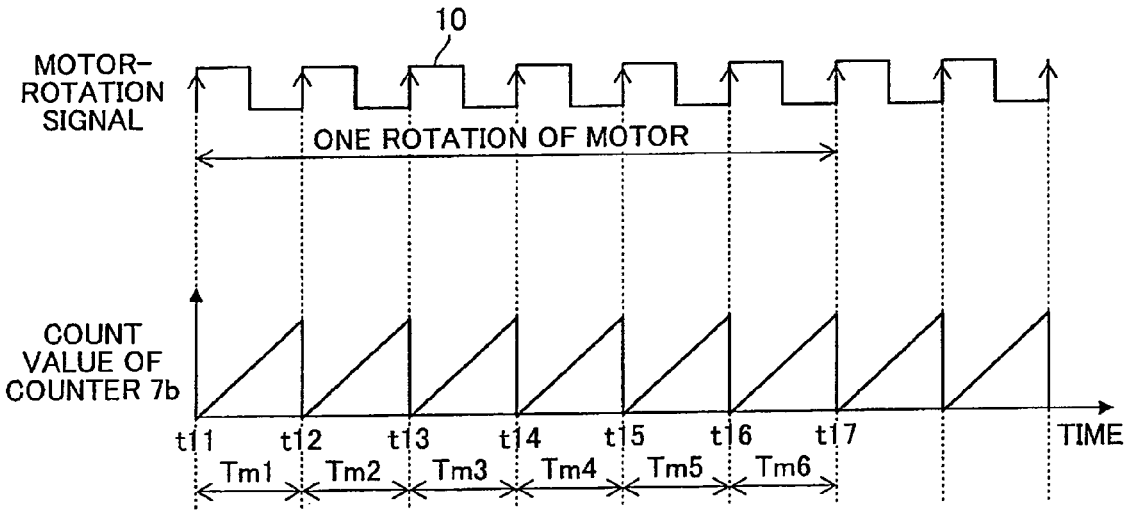
FIG. 6 is a timing chart showing the motor-rotation signal and a count value in counter 7*b;*
Figure 7:
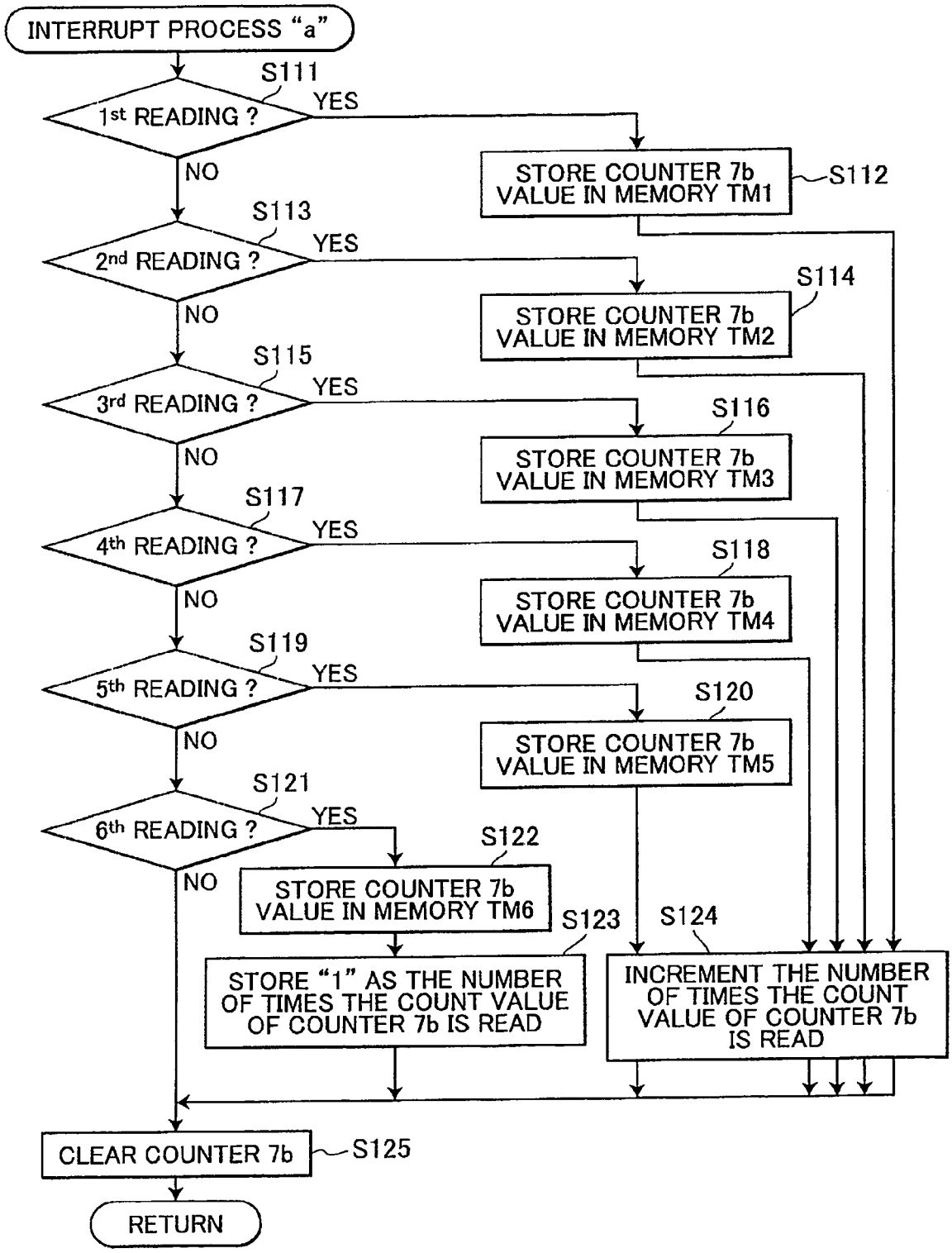
FIG. 7 is a flowchart illustrating an interrupt process "a"

In the main flowchart shown in FIG. 4, a computation process of a motor-rotation signal frequency fm is initially executed (step 31). Details of this process will be described with reference to FIGS. 5 through 7. FIG. 5 is a flowchart illustrating the computation process of the motor-rotation signal frequency fm. FIG. 6 is a timing chart showing the motor-rotation signal and count value of the counter 7*b*. FIG. 7 is a flowchart illustrating an interrupt process "a".

In the computation process of the motor-rotation signal frequency fm shown in the flowchart of FIG. 5, the pulse-to-pulse time duration of the motor-rotation signal 10 is measured by the counter 7*b*. Specifically, the counter 7*b* counts up the number of clocks generated from the clock 7*e* oscillating at a predetermined frequency of, for example, 20 MHz during a period of time from the rising edge of a pulse of the motor-rotation signal to the succeedingly occurring rising edge (step 101). During the count-up operation by the counter 7*b*, the interrupt process "a" is executed. The CPU 7*a* executes the interrupt process "a" at timings t11, t12 and on shown in FIG. 6 when the rising edge of the motor-rotation signal 10 is detected. The interrupt process "a" is so programmed that the CPU 7*a* reads the count value of the counter 7*b*, stores it into the memory of the CPU 7*a*, and then clears the count value of the counter 7*b*.

Specifically, as shown in FIG. 6, the counter 7*b* is cleared at t11 in timed relation with the rising edge of the pulse of the motor-rotation signal 10. From t11 to t12, count-up operation by the counter 7*b* is performed. At t12, the succeedingly occurring rising edge of the motor-rotation signal 10 is detected, causing the interrupt process "a" to execute again. As shown in FIG. 7, the interrupt process "a" first determines whether it is the first time for the CPU 7*a* to read or retrieve the count value of counter 7*b* (step 111). When it is the first time for the CPU 7*a* to read the count value of counter 7*b* (step 111: YES), the count value X1 of counter 7*b* is stored in the memory TM1 (step 112). Subsequently, the number of times the count value of counter 7*b* is read by the CPU 7*a* is incremented (step 124). Here, this number is "1". The counter 7*b* is then cleared (step 125) and the routine returns to step 101.

Similarly, the counter 7*b* counts up the clocks during a period of time from t12 to t13. At t13, the interrupt process "a" is executed. When the interrupt process "a" determines that it is the second time for the CPU 7*a* to read the count value of counter 7*b* (step 113: YES), the count value X2 of the counter 7*b* is stored in the memory TM2 (step 114). Subsequently, the number of times the count value of counter 7*b* is read by the CPU 7*a* is incremented (step 124). Here, this number is "2". The counter 7*b* is then cleared (step 125) and the routine returns to step 101.

In the manner described above, the interrupt processes "a" are subsequently executed at every timing in coincidence with the rising edge of the pulses of the motor-rotation signal 10, and the count values X3 through X6 of the counter 7*b* are read by the CPU 7*a* and stored in the memories TM3 through TM6, respectively (steps 115 through 122). After reading the count value of the counter 7*b* for six times (step 121: YES) and storing the count value X6 in the memory TM6 (S122), "1" is stored in the separate region of the memory to indicate the number of times that a set of count values of the counter 7*b* is read (step 123), and then the counter 7*b* is cleared (step 125), whereupon the routine returns to step 101. As a result of the series of steps described above, the count values X1 through X6 counted during the time intervals Tm1 through Tm6, respectively, have been stored in the relevant storage regions of the memory.

Referring back to the flowchart of FIG. 5, the count value X1 is read out from the memory TM1 (step 102). Assuming that the counter 7*b* performs count-up operations at the frequency of fc Hz (equal to the clock frequency), each count-up operation requires 1/fc seconds. Because the count value during the time interval Tm1 is X1, the time interval from t11 to t12 is X1/fc. Accordingly, the motor-rotation signal frequency is fc/X1 Hz. This value is stored in the memory of the control unit 7 as the motor-rotation signal frequency fm (step 103). The motor-rotation signal frequency fm may be computed using any one of the count values X2 through X6.

When the motor-rotation signal 10 shows such a waveform that six pulses occur at an equi-pitch per one rotation of the motor 4 as shown in FIG. 3, the rotational frequency of the motor 4 is given by fc/(X1+X2+X3+X4+X5+X6) Hz. This rotational frequency of the motor 4 is used as a basis for controlling the rotations of the motor 4.

Figure 8:
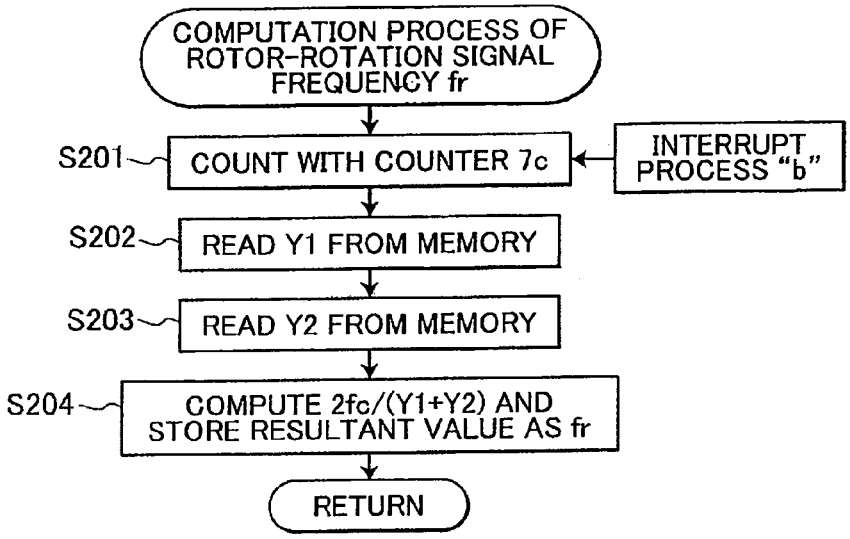
FIG. 8 is a flowchart illustrating a computation process of a rotor-rotation signal frequency.
Figure 9:
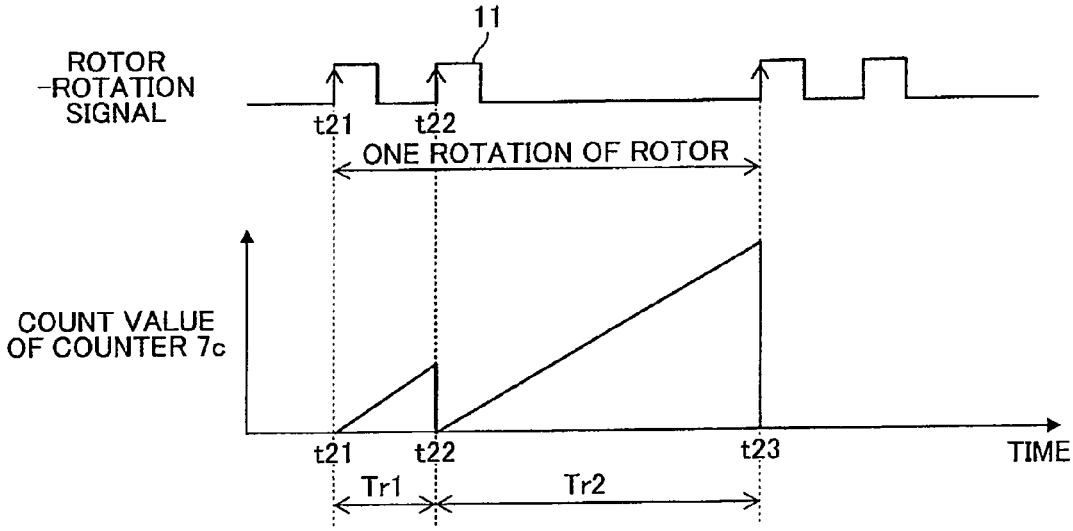
FIG. 9 is a timing chart showing the rotor-rotation signal and a count value in counter 7*c;*
Figure 10:
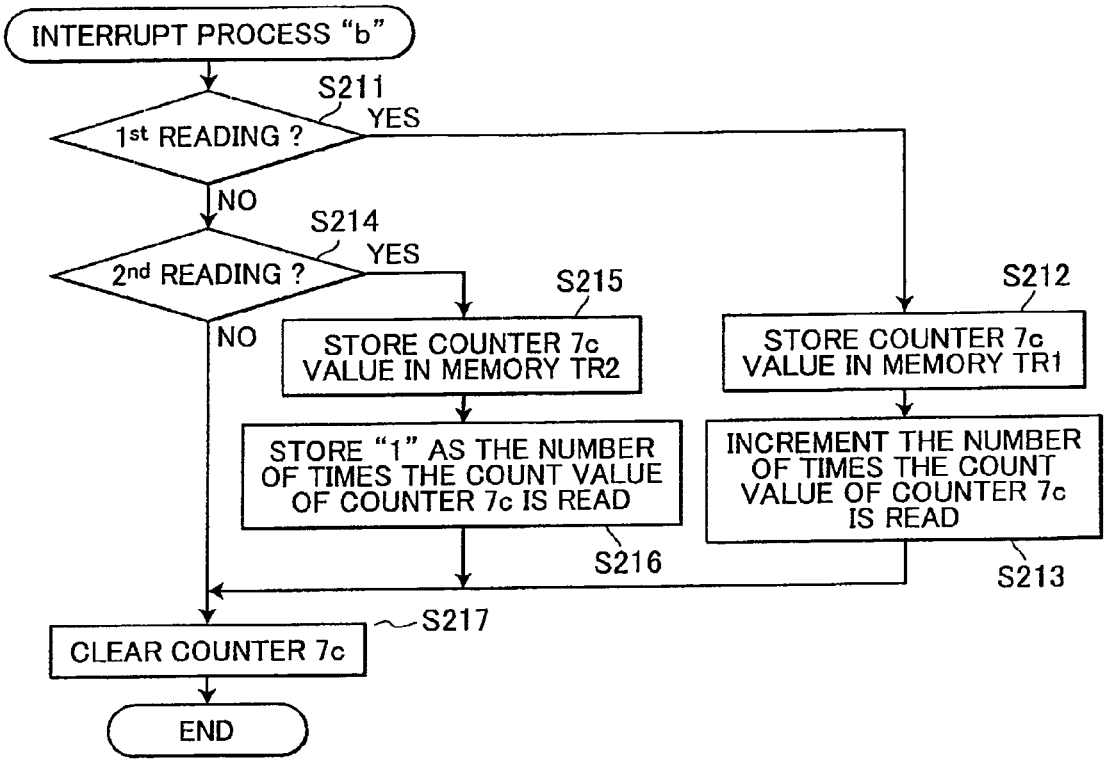
FIG. 10 is a flowchart illustrating an interrupt process "b"

Referring back to the flowchart of FIG. 4, after execution of step 31, computation process of the rotor-rotation signal frequency fr is executed (step 32), which will be described with reference to FIGS. 8 through 10. FIG. 8 is a flowchart illustrating a computation process of the rotor-rotation signal frequency. FIG. 9 is a timing chart showing the rotor-rotation signal 11 and a count value in the counter 7*c*. FIG. 10 is a flowchart illustrating an interrupt process "b".

In the computation process of the rotor-rotation signal frequency fr shown in the flowchart of FIG. 8, the pulse-to-pulse time duration of the rotor-rotation signal 11 is measured by the counter 7*c*. Specifically, the counter 7*c* counts up the number of clocks generated from the clock 7*e* during a period of time from the rising edge of a pulse of the rotor-rotation signal to the succeedingly occurring rising edge (step 201). During the count-up operation by the counter 7*c*, the interrupt process "b" is executed. The CPU 7*a* executes the interrupt process "b" at timings t21, t22 and on as shown in FIG. 9 when the rising edge of the rotor-rotation signal 11 is detected. The interrupt process "b" is so programmed that the CPU 7*a* reads the count value of the counter 7*c*, stores it into the memory of the CPU 7*a*, and then clears the count value of the counter 7*c*.

Specifically, as shown in FIG. 9, the counter 7*c* is cleared at t21 in timed relation with the rising edge of the pulse of the rotor-rotation signal 11. From t21 to t22, count-up operation by the counter 7*c* is performed. At t22, the succeedingly occurring rising edge of the rotor-rotation signal 11 is detected, causing the interrupt process "b" to execute again. As shown in FIG. 10, the interrupt process "b" first determines whether it is the first time for the CPU 7*a* to read or retrieve the count value of counter 7*c* (step 211). When it is the first time for the CPU 7*a* to read the count value of counter 7*c* (step 211: YES), the count value Y1 of counter 7*c* is stored in the memory TR1 (step 212). Subsequently, the number of times the count value of counter 7*c* is read by the CPU 7*a* is incremented (step 213). Here, this number becomes "1". The counter 7*c* is then cleared (step 217) and the routine returns to step 211.

Similarly, the counter 7*c* counts the clocks during a period of time from t22 to t23. At t23, the interrupt process "b" is executed. When the interrupt process "b" determines that it is the second time for the CPU 7*a* to read the count value of counter 7*c* (step 214: YES), the count value Y2 of the counter 7*c* is stored in the memory TR2 (step 215). Further, "1" is stored in the separate region of the memory to indicate the number of times that a set of count values of the counter 7*b* is read (step 216), and then the counter 7*c* is cleared (step 217), whereupon the routine returns to step 201. As a result of the steps described above, the count values Y1 and Y2 counted during the time interval Tr1 and Tr2 have been stored in the relevant storage regions of the memory.

Referring back to the flowchart of FIG. 8, the count value Y1 is read out from the memory TR1 (step 202) and then the count value Y2 is read out from the memory TR2 (step 203).

As shown in FIG. 3, the rotor-rotation signal 11 in accordance with the first embodiment shows such a waveform in which pulses are not generated at an equi-pitch. Two pulses are generated per one rotation of the rotor 2. The timings at which the two pulses are generated are different depending upon the type of the rotor, so that the type of the rotor 2 can be discriminated based on the detected timings of the two pulses.

The rotor-rotation signal frequency fr cannot be determined from only the count value Y1 counted during the time interval Tr1 (from t21 to t22) shown in FIG. 9. As is done for the computation of the rotational frequency of the motor 2, the rotational frequency of the rotor 2 is computed using a sum of the count values in the time intervals Tr1 and Tr2. That is, the rotational frequency of the rotor 2 is given by fc/(Y1+Y2) Hz. Because two pulses occur per one rotation of the rotor 2, an average rotor-rotation signal frequency fr is given by doubling the rotational frequency of the rotor 2 thus computed. To summarize, the following equations are obtained.

$$fr=(\text{rotational frequency of rotor } \mathbf{2})\times 2=2fc/(Y1+Y2)$$

Referring to the flowchart of FIG. 8, the rotor-rotation signal frequency fr as give above is stored in the memory (step 204). Note that when the pulses of the rotor-rotation signal 11 occur at an equi-pitch, the frequency of the pulses calculated based on the pulse-to-pulse time duration is equal to the rotor-rotation signal frequency fr.

Referring back to FIG. 4, a frequency ratio A of the motor-rotation signal frequency fm to the rotor-rotation signal frequency fr is computed, i.e., A=fm/fr, (step 33). In the centrifugal separator in accordance with the first embodiment, the motor-rotation signal generator 4*d* generates six pulses per one rotation of the motor 4 whereas the rotor-rotation signal generator 8 generates two pulses per one rotation of the rotor 2, as shown in FIG. 3. The pulses thus generated are applied to the CPU 7*a*. In accordance with the first embodiment, with the pulleys 4*b* and 3*a* provided respectively to the driving shaft 4*a* of the motor 4 and the rotational shaft 3 of the rotor 2, the rotation number of the rotor 2 is reduced to one second (1/2) with respect to that of the motor 4. This means that the rotor 2 makes one rotation for two rotations of the motor 4. That is, the pulleys 4*b* and 3*a* have such a configuration as to achieve a speed reduction ratio of 1/2. Assuming that no belt slippage occurs, the frequency ratio A is 6. It should be noted that with two rotations of the motor 4, the rotor 2 makes one rotation, and six pulses are generated from the motor-rotation signal generator 4*d* per one rotation of the motor 4 and two pulses from the rotor-rotation signal generator 8 per one rotation of the rotor 2. Thus, the frequency ratio A can be calculated by (6 pulses×2 rotations):(2 pulses×1 rotation)=6:1. Actually, however, the slippage of the belt 5 occurs to some extent. Accordingly, an operating status of the driving power transmission mechanism or the operating status of the belt 5 is monitored. The operating status is judged to be acceptable if the frequency ratio A calculated in step 33 falls into a first predetermined range of, for example, $5 \leqq A \leqq 7$ (step 34). In this case, driving of the motor 4 is continued as the slippage of the belt 5 within this range does not cause a substantial problem.

On the other hand, when the tension of belt 5 is lowered due to wear of the belt 5 or loosening of the belt 5, the slippage of the belt 5 will occur. Particularly, during acceleration or deceleration period of the rotor 2, it is highly likely that slippage occurs if the rotor's moment of inertia is large or the rotor's air loss is high and so strong resistive force is applied to the rotor 2. As a result, the frequency ratio A may exceed the upper limit of the first predetermined range and fall into a second predetermined range of, for example, $4 \leqq A \leqq 8$. If so, it can be understood that the degree of slippage has increased as compared with the operating status judged to be acceptable. The operating status falling in the second predetermined range is considered to be a near malfunction status in which continuous driving can be performed and replacement or adjustment of the belt 5 is not essential for the time being but maintenance needs to be performed as soon as possible. In the near malfunction status, a warning message or warning indication is displayed in the display panel 12 to alert the user of this fact (step 36). As described, when the degree of slippage is not so great, the user is only warned and prompted to perform maintenance.

When the frequency ratio A further exceeds the upper limit of the second predetermined range, an alarm message or alarm indication is displayed in the display panel 12 (step 37) and the motor 4 is forcibly stopped (step 38). This condition is considered to be a malfunction status. If the belt 5 is not replaced with a new one or tension adjustment is not performed despite the fact that the user is warned, the operating status would get worse and reach the malfunction status.

Figure 11A:
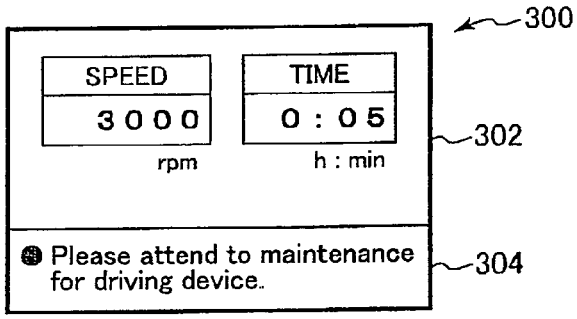
FIGS. 11A and 11B show an example of a display device employing a liquid crystal display.
Figure 11B:
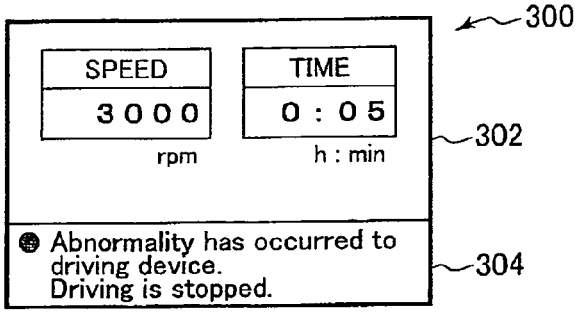

The warning and alarm displays will be described with reference to FIGS. 11A-11B and 12A-12B. FIGS. 11A and 11B show an example of a display device 300 employing liquid crystal display (LCD) The display device 300 is a part of the display panel 12 shown in FIG. 1. The display device 300 includes a status display portion 302 for displaying the driving status of the centrifugal separator 1, and a message display portion 304. A warning message is displayed in the message display portion 304 as shown in FIG. 11A when the driving power transmission mechanism or the belt 5 is in the near malfunction status. An alarm message is displayed in the message display portion 304 as shown in FIG. 11B.

Figure 12A:
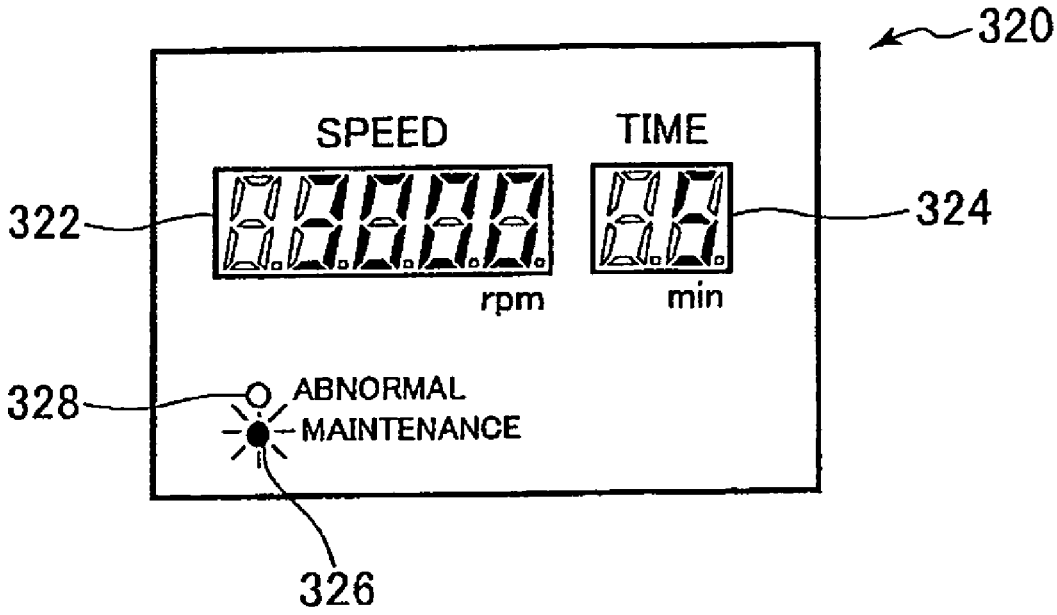
FIGS. 12A and 12B show another example of the display device employing light emitting diodes.

FIG. 12A shows another example of a display device 320 employing light emitting diodes (LEDs). As shown in FIG. 12A, the display device 320 includes a speed display portion 322, time display portion 324, alarm lamp 326, and warning lamp 328. The warning display is performed by lighting the warning lamp 328, and the alarm display by lighting the alarm lamp 326.

Figure 12B:
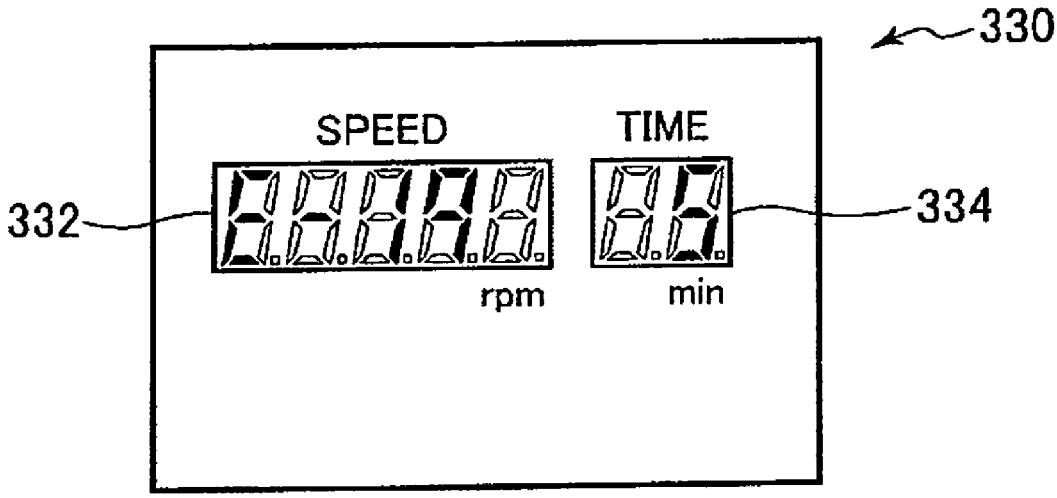

FIG. 12B shows still another example of the display device 330 similar to the example shown in FIG. 12A. Unlike the example shown in FIG. 12A, the display device 330 shown in FIG. 12B is not provided with the warning and alarm lamps 328, 326. In the example shown in FIG. 12B, the speed display portion 332 is used to indicate a relevant error number previously determined corresponding to the error or alarm messages. For example, an error number "E-19" is indicated in the speed display portion 332 to indicate an alarm that the driving device is in an abnormal or malfunction status.

As described above, the centrifugal separator in accordance with the first embodiment generates the motor-rotation signal 10 and the rotor-rotation signal 11. The former signal is in the form of a pulse train with a pulse frequency in proportion to the frequency of the motor rotations. The latter signal is also in the form of a pulse train with a pulse frequency in proportion to the frequency of the rotor rotations. Based on the motor-rotation signal 10 and the rotor-rotation signal 11, the motor-rotation signal frequency fm and the rotor-rotation signal frequency fr are computed. The frequency ratio A of the rotational speed of the motor 4 to that the rotor 2 is used as a parameter to judge the degree of wear of the belt, because in the belt driven centrifugal separator, wear of the belt tends to increase when the slippage of the belt occurs.

Computation of these frequencies fm and fr requires measurements of pulse-to-pulse time duration of each of the motor-rotation signal 10 and the rotor-rotation signal 11 using the counters 7*b* and 7*c* and also computation of a time duration corresponding to one rotation of the motor 4 or the rotor 2. Through the above computations, the frequencies of the pulses of the motor-rotation signal 10 and the rotor-rotation signal 11 can be computed with high accuracy within a short period of time.

Further, it is possible to recognize the degree of malfunction of the driving power transmission mechanism, particularly wear of the belt 5, from the computed frequency ratio A. Specifically, when the computed frequency ratio A exceeds the upper limit of the first predetermined range and falls within the second predetermined range, a warning message or indication is displayed on the display device to alert the user that the driving power transmission mechanism or the belt 5 is in the near malfunction status and to prompt the user to carry out maintenance. When the computed frequency ratio A exceeds the upper limit of the second predetermined range, an alarm message or indication is displayed on the display device to alert the user that the belt 5 is in the malfunction or abnormal status. At the same time, the motor 4 is forcibly stopped. In this manner, the centrifugal separator 1 of the type in which rotations of the motor 4 are transmitted to the rotor 2 via the driving power transmission mechanism can be continuously driven if the driving power transmission mechanism is in the near malfunction status, yet warning the user to perform maintenance.

It should be noted that the first predetermined range is set to such a range that a belt is durable according to data ever obtained. When the computed frequency ratio A falls within the first predetermined range, the user is advised of performing maintenance before the wear of the belt increases. When wear of the belt 5 increases resulting from occurrence of slippage, the frequency ratio A increases. As the frequency ration A increases, the load imposed on the motor 4 increases. Accordingly, if the frequency ratio A exceeds the upper limit of the first predetermined range and falls into the second predetermined range, the alarm display is performed and also the motor 4 is forcibly stopped. By doing so, the motor 4 is prevented from being damaged by the overload and also the driving power transmission mechanism is prevented from being seriously damaged.

Next, a centrifugal separator in accordance with a second embodiment of the invention will be described. In the following description, the same components as those in the first embodiment will be denoted by the same reference numerals and description thereof is omitted to avoid duplicate description.

Figure 13:
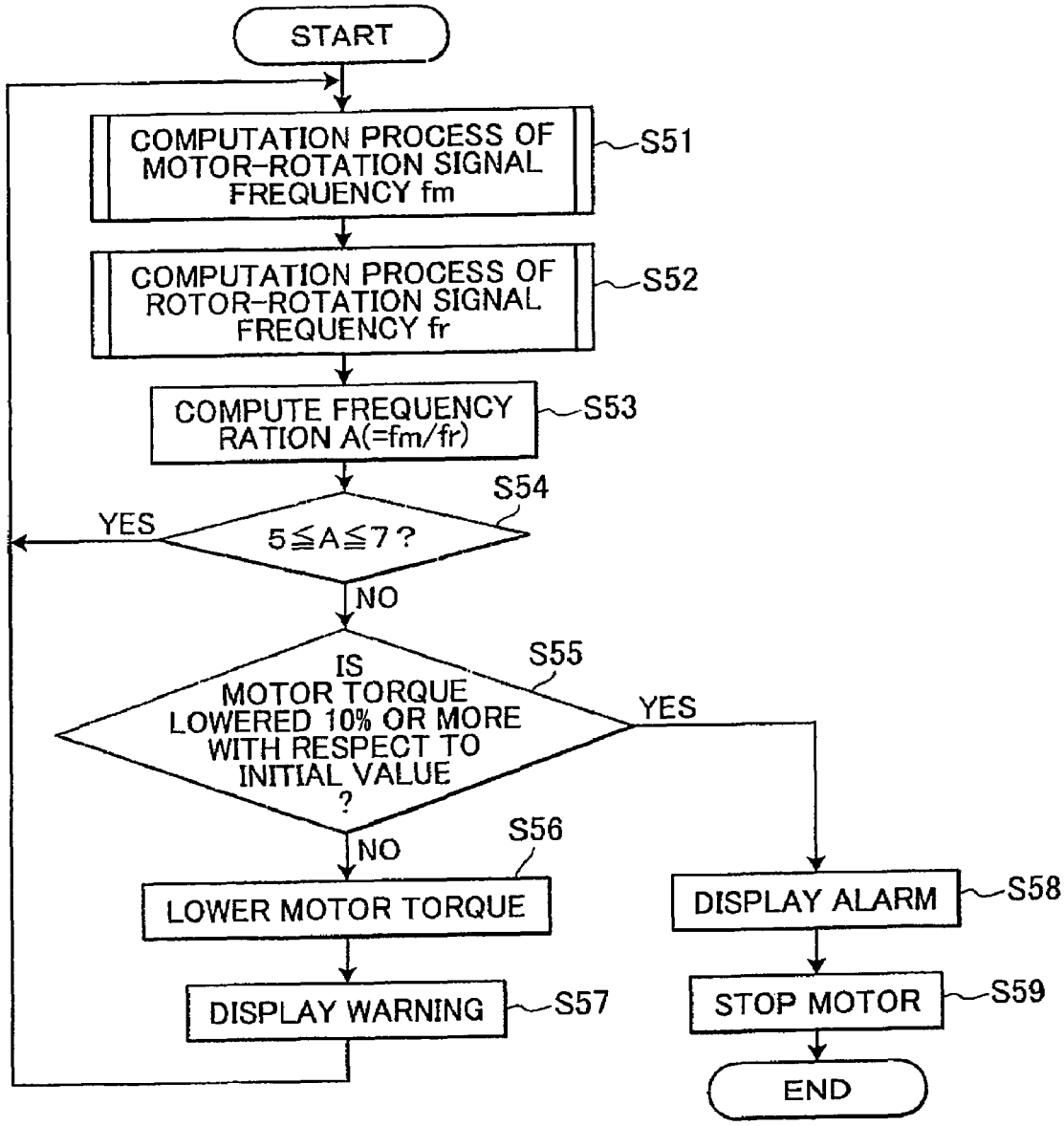
FIG. 13 is a flowchart illustrating operation of a centrifugal separator in accordance with a second embodiment of the invention.

FIG. 13 is a flowchart illustrating operation of the centrifugal separator in accordance with the second embodiment of the invention. As executed for the centrifugal separator of the first embodiment, computation process of the motor-rotation signal frequency fm (step 51), computation process of the rotor-rotation signal frequency fr (step 52), and computation of the frequency ratio A are executed.

Next, it is determined whether the computed frequency ratio A falls within the first predetermined range ($5 \leqq A \leqq 7$) (step 54). When the frequency ratio A falls within the first predetermined range (step 54: YES), the belt is determined to be in an acceptable status. In this case, the routine returns to step 51 and the motor 4 is subject to acceleration/deceleration control to be rotated with a normal torque.

On the other hand, when the tension of belt 5 is lowered due to wear of the belt 5 or loosening of the belt 5, slippage of the belt tends to occur. Particularly, during acceleration or deceleration period of the rotor 2, it is highly likely that slippage occurs if the rotor's moment of inertia is large or the rotor's air loss is high and so strong resistive force is applied to the rotor 2. As a result, the frequency ratio A increases and exceeds the upper limit of the first predetermined range, particularly when the motor is accelerating or decelerating. In the first embodiment, only a warning message or indication is displayed on the display device. In the second embodiment, torque control of the motor 4 is performed to prevent occurrence of slippage of the belt 5. Specifically, the CPU 7*a* of the control unit 7 determines that the degree of slippage increases when the computed frequency ratio A exceeds the upper limit of the first predetermined range and the CPU 7*a* instructs the motor control circuit 7*d* to control the torque of the motor 4 so that the frequency ratio A falls with the first predetermined range.

The fact that the frequency ratio A exceeds the upper limit of the first predetermined range indicates that rotations of the rotor 2 are not in full compliance with the torque of the motor 4. Accordingly, in order to change the frequency ratio A to fall within the first predetermined range, it is necessary to decrease the torque of the motor 4. To this end, it is determined whether or not the torque of the motor 4 is lowered 10% or more with respect to an initially set torque value (step 55). It should be noted that the toque of motor 4 is computed, for example, by measuring change in the rotational speed of the motor 4. It should also be noted that how the motor torque control is carried out is different depending upon the type of the motor used. For example, the CPU 7*a* of the control unit 7 controls the motor control circuit 7*d* so as to decrease current flowing in the motor 4. The current control may be carried out with a PWM inverter. In this case, the CPU 7*a* controls the width of a switching pulse applied to a transistor or an FET connected in a path for flowing the current in the motor 4. It is desirable that a limiter be provided to set an allowable range in which the torque can change.

When the torque of the motor 4 is not lowered 10% or more with respect to the initially set torque value (step 55: NO), the torque of the motor 4 is lowered 1% (step 56) and then the warning display is performed (S57), whereupon the routine returns to step 51. When the torque of the motor 4 is lowered 10% ore more, that is, at the time of eleventh execution of step 55, the alarm display is performed (step 58) and at the same time the motor is forcibly stopped (step 59). The warning and alarm displays are performed by indicating relevant messages, lighting lamps, or indicating predetermined error numbers as is done in the first embodiment.

As described, the second embodiment alerts the user of the first stage of malfunction by not only performing the warning display but also lowering the motor torque if the motor torque has not been lowered 10%. While lowering the motor torque prolongs the acceleration or deceleration period of time and thus lowers the property of the centrifugal separator, it is advantageous in that the rotor can still be accelerated up to a target rotational speed set by the user. As such, the slightly deteriorated belt can still be used without need for immediate replacement of the belt 5 or immediate tension adjustment. It is further advantageous in that lowering the motor torque lessens the progress of the belt wear.

Although the present invention has been described with respect to specific embodiments, it will be appreciated by one skilled in the art that a variety of changes may be made without departing from the scope of the invention. For example, in the centrifugal separator in accordance with the first and second embodiments, the driving power transmission mechanism for transmission of driving power from the motor 4 to the rotor 2 is configured from the pulleys 4*b*, 3*b* and the belt 5, a different type of the driving power transmission mechanism can be employed in the centrifugal separator shown in FIG. 1.

Figure 14A:
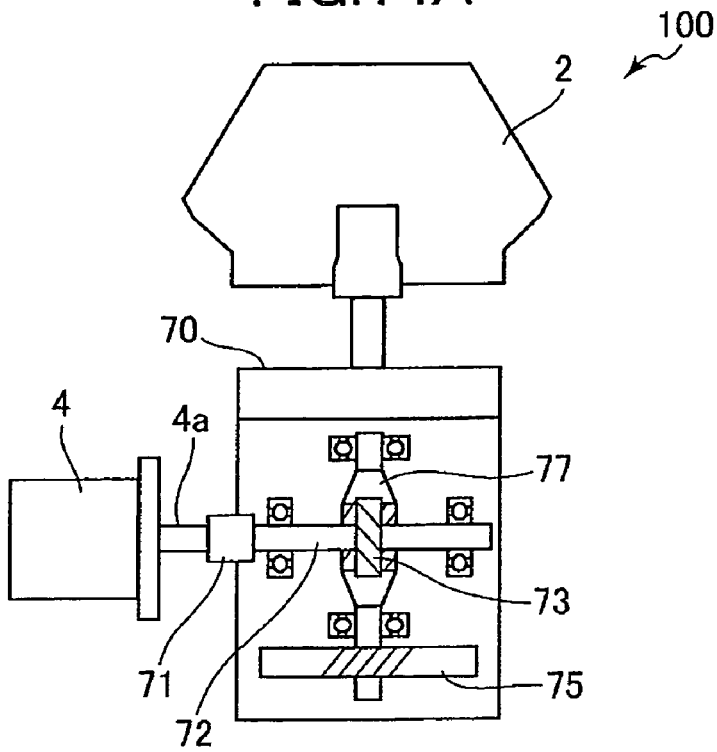
FIG. 14A is a front view showing alternative driving power transmission mechanism applicable to the centrifugal separator shown in FIG. 1.
Figure 14B:
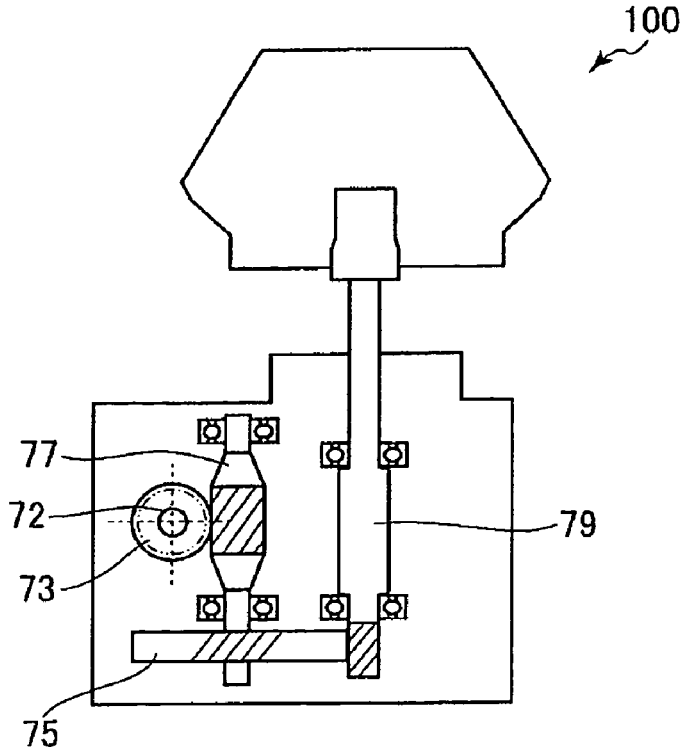
FIG. 14B is a side view of the driving power transmission mechanism shown in FIG. 14A.

Such an example is shown in FIGS. 14A and 14B. FIG. 14A is a front view and FIG. 14B is a side view showing an alternative driving power transmission mechanism together with the motor 4 and the rotor 2. In the example shown in FIGS. 14A and 14B, a gear box 70 serves as the driving power transmission mechanism. The gear box 70 is coupled between the motor 4 and the rotor 2 and transmits the driving power of the motor 4 to the rotor 2. The driving shaft 4*a* rotates with the motor 4 and the driving power of the motor 4 is transmitted via a coupling 71 to a rotational shaft 72. Rotations of the rotational shaft 72 are transmitted via a gear 73 to a pinion 77. Rotations of the pinion 77 is further transmitted via a gear 75 to the rotor's rotational shaft 79, thereby rotating the rotor 2 connected to the rotational shaft 79.

With the centrifugal separator 100 shown in FIGS. 14A and 14B, the gear box 70 serving as the driving power transmission mechanism is configured from the gears 73, 75 and the pinion 77.

Further, in order to obtain the motor-rotation signal frequency fm and the rotor-rotation signal frequency fr, the number of pulses of the motor-rotation signal or the rotor-rotation signal which occur per unit time may be counted. For example, counting the number of pulses Pm and Pr with the respective counters gives the motor-rotation signal frequency fm and the rotor-rotation signal frequency fr, i.e., fm=Pm (Hz), and fr=Pr (Hz).

Further, the number of pulses defining the motor-rotation signal 10 and the rotor-rotation signal 11 and the speed reduction ratio between the pulleys 4*b* and 3*a* are not limited to those described in the first and second embodiments and may be set to different number or values. The first and second predetermined ranges change depending on the change in those number and/or values because the frequency ratio A changes depending thereupon.

In the first and second embodiments of the invention, the counters 7*b* and 7*c* are connected to CPU 7*a* within the control unit 7. However, the counters 7*b* and 7*c* may be internally provided within the CPU 7*a*.

In the second embodiment of the invention, the motor torque is lowered on a step-by-step basis, 1% at a time. However, the lowering degree of the motor torque in each step is not limited to 1% but may be set to another value, or can be changed depending upon the type of the rotor 2.

What is claimed is:

1. A centrifugal separator comprising:

a motor that has a driving shaft and generates driving power;

a rotor that is configured to accommodate a sample subject to centrifuge;

a rotational shaft that supports the rotor to be rotatable therewith;

a driving power transmission mechanism that is coupled between the driving shaft and the rotational shaft and transmits the driving power of the motor to the rotational shaft on which the rotor is supported;

a monitoring unit that monitors an operating status of the driving power transmission mechanism and outputs a status signal indicative of the operating status of the driving power transmission mechanism;

a motor control unit that controls the motor; and a multi-stage alerting unit that alerts a user that the driving power transmission mechanism is one of a predetermined number of different stage malfunction statuses based on the status signal output from the monitoring unit.

2. The centrifugal separator according to claim 1, wherein the predetermined number of different stage malfunction statuses includes a first stage malfunction status and a second stage malfunction status, wherein the first stage malfunction status is less serious in degree of malfunction than the second stage malfunction status.

3. The centrifugal separator according to claim 2, wherein the motor control unit forcibly stops rotations of the motor when the multi-stage alerting unit alerts the user that the driving power transmission mechanism is in the second stage malfunction status.

4. The centrifugal separator according to claim 2, wherein the motor control unit controls the motor to decrease torque of the motor when the multi-stage alerting unit alerts the user that the driving power transmission mechanism is in the first stage malfunction status.

5. The centrifugal separator according to claim 4, wherein the motor control unit controls the motor to decrease the torque of the motor on a step-by-step basis when the multi-stage alerting unit alerts the user that the driving power transmission mechanism is in the first stage malfunction status.

6. The centrifugal separator according to claim 5, wherein the multi-stage alerting unit alerts the user that the driving power transmission mechanism is in the second stage malfunction status when the torque of the motor has decreased to a predetermined level.

7. The centrifugal separator according to claim 2, wherein the multi-stage alerting unit comprises a display device.

8. The centrifugal separator according to claim 7, wherein the display device selectively displays one of a first indication corresponding to the first stage malfunction status, and a second indication corresponding to the second stage malfunction status.

9. The centrifugal separator according to claim 8, wherein the display device selectively displays one of a warning message corresponding to the first stage malfunction status, and an alarm message corresponding to the second stage malfunction status.

10. The centrifugal separator according to claim 1, wherein the monitoring unit comprises:

a first pulse generator that generates a first pulse signal having a first frequency determined depending upon a rotational frequency of the motor;

a second pulse generator that generates a second pulse signal having a second frequency determined depending upon a rotational frequency of the rotor; and a computing unit that computes a frequency ratio of the first frequency to the second frequency.

11. The centrifugal separator according to claim 10, further comprising a display device that displays a warning message when the frequency ratio computed by the control unit is out of a first predetermined range.

12. The centrifugal separator according to claim 10, wherein the motor control unit controls the motor to stop rotations when the frequency ratio computed by the control unit exceeds upper limit of a second predetermined range, the second predetermined range including the first predetermined range and covering a broader range than the first predetermined range.

13. The centrifugal separator according to claim 10, wherein the motor control unit controls torque of the motor so that the frequency ratio falls within the first predetermined range.

14. The centrifugal separator according to claim 10, wherein the driving power transmission mechanism comprises a first pulley provided to the driving shaft of the motor, a second pulley provided to the rotational shaft, and a belt that is supported between the first pulley and the second pulley and transmits the driving power generated by the motor to the rotational shaft.

* * * * *